United States Patent [19]

Froom

[11] 4,239,115

[45] Dec. 16, 1980

[54] FOLDING ICE-CREAM CARTON AND CARTON BLANK THEREFOR

[75] Inventor: Thomas W. Froom, Pittsford, N.Y.

[73] Assignee: Rendoll Paper Corporation, Rochester, N.Y.

[21] Appl. No.: 842,747

[22] Filed: Oct. 17, 1977

[51] Int. Cl.[2] ..... B65D 5/70

[52] U.S. Cl. ..... 206/611; 206/626

[58] Field of Search ..... 229/33, DIG. 9; 206/626, 611

[56] References Cited

U.S. PATENT DOCUMENTS

| | | | |
|---|---|---|---|
| 1,509,383 | 9/1924 | Walter | 229/33 |
| 2,367,008 | 1/1945 | Davidson | 229/33 |
| 2,367,780 | 1/1945 | Inman | 229/DIG. 9 |
| 2,369,385 | 2/1945 | Carruth et al. | 229/33 |
| 3,040,957 | 6/1962 | Meyers | 229/33 |
| 3,144,980 | 8/1964 | Larson | 206/626 |
| 3,195,800 | 7/1965 | Cote | 229/33 |
| 3,265,285 | 8/1966 | Fanter | 206/626 |

*Primary Examiner*—Stephen P. Garbe

*Attorney, Agent, or Firm*—Gordon W. Hueschen

[57] ABSTRACT

A carton for packaging semi-fluid material, such as ice cream, and the like, is formed from specially constructed integral carton blank and a special process for assembling the same. The carton blank has a front panel, a bottom panel, a rear panel, a cover panel, and a front cover sealing flap articulated one to the other in the order named, with end-forming flaps and glue-flap extensions extending laterally therefrom adapted to be glued together to form inner and outer walls and side-cover flaps. The bottom outer wall-forming flap is glued to the inner wall-forming flaps by glue strips along the side edges of the latter, where they are joined to the front and rear panels, and the side-cover flap has a tuck-in tab adapted to be tucked in under the bottom outer wall-forming flap between the glue strips. The glue-flap extensions are adapted to fold over the side-cover flaps and to be glued thereto by an extension of the glue strip adjacent the front of the carton. In forming the carton, one end is closed first by folding in the side flap extensions, folding down the side-cover flap, applying the glue strips with the one adjacent the front of the carton extending up over the folded-down side-cover flap, then folding up the bottom outer wall-forming flap to a position overlying the tuck-in tab and folding in the glue-flap extensions over the glue strip on the side-cover flap and causing adherence between the glue and the folded-in flaps.

27 Claims, 21 Drawing Figures

Fig. 5
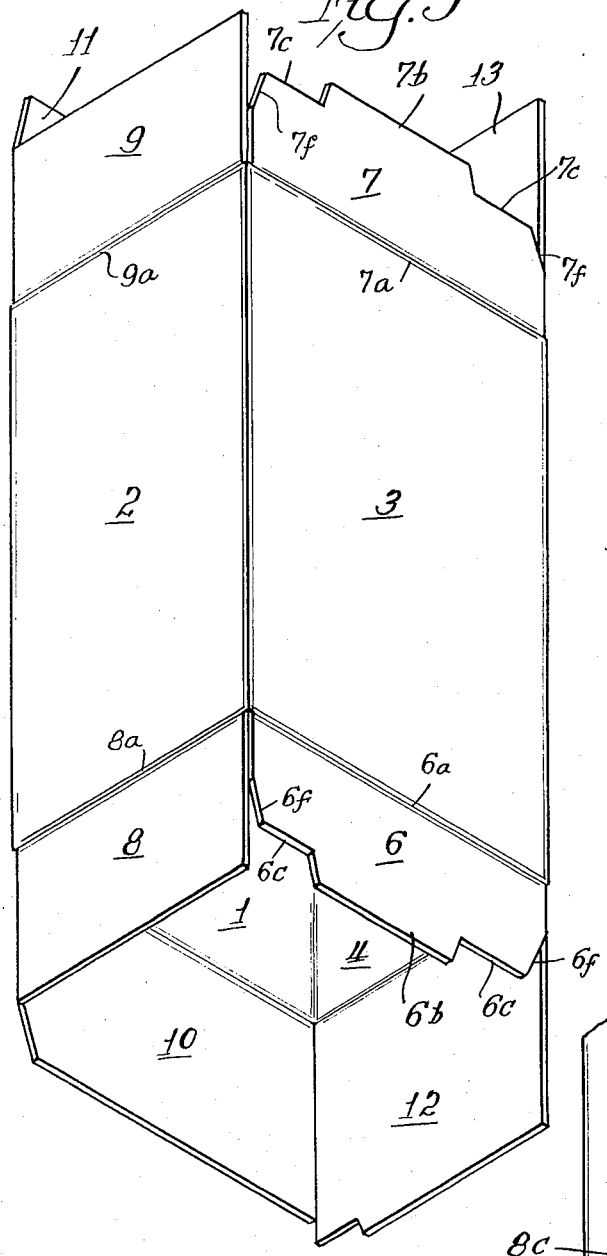
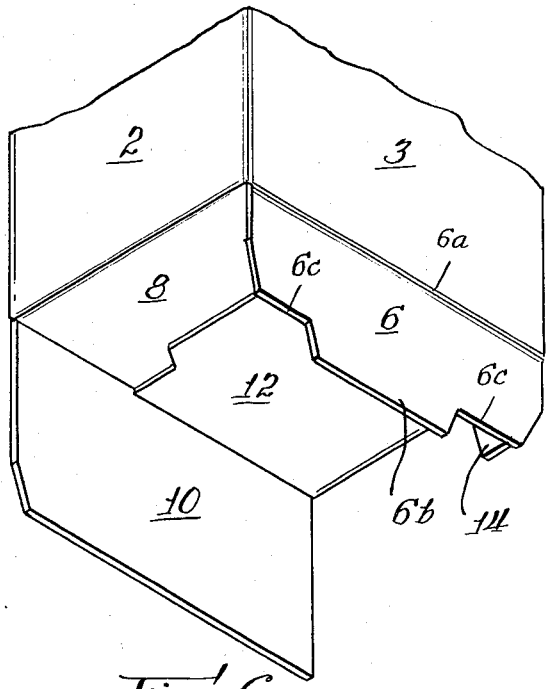
Fig. 6.
Fig. 7.
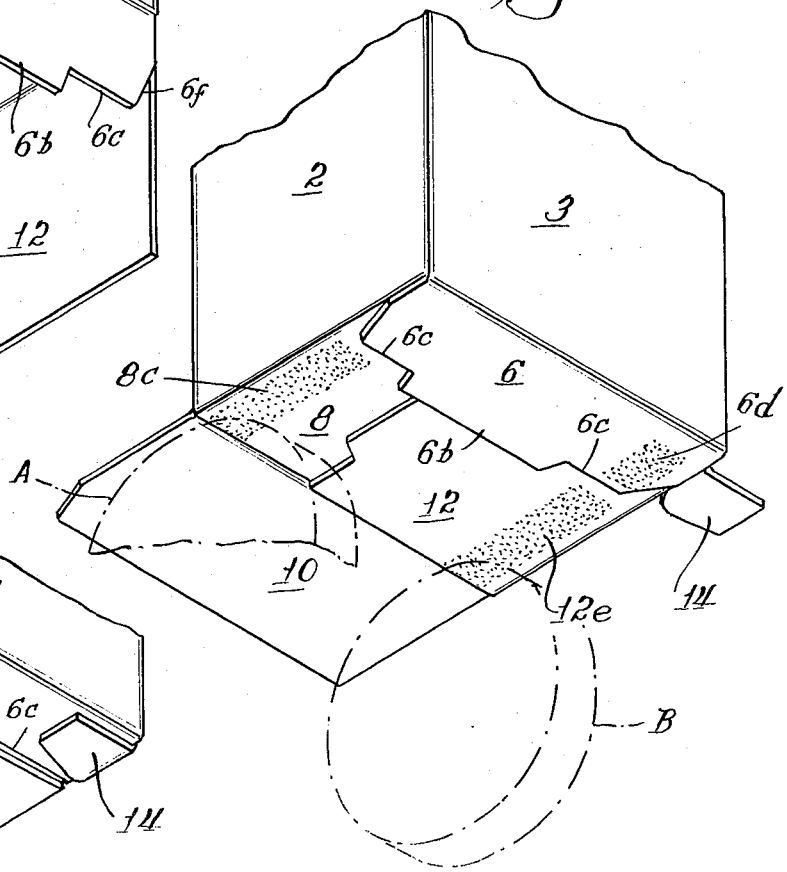
Fig. 8
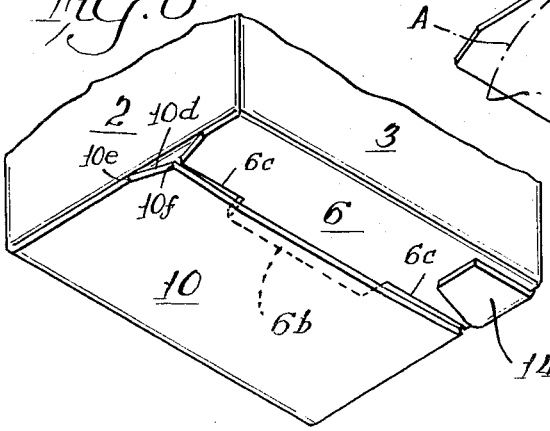

105
114
115
107
101
106
Y
Y
109
102
108
111
103
110
113
X
X
104
Z
Z
113b
104f
112
112b

FOLDING ICE-CREAM CARTON AND CARTON BLANK THEREFOR

FIELD OF INVENTION AND PRIOR ART

This invention relates to the art of packaging and is particularly directed to novel carton blank, a novel carton, a novel package and novel methods of preparing the same, which embodies into an ice-cream carton the salient features of earlier U.S. Pat. No. 3,040,957, which embodies all of the salient features of U.S. Pat. No. 1,509,383. In the prior art carton, however, the bottom outer wall forming flap overlaps the entire side cover flap and is glued to the inner wall-forming flaps by horizontal glue strip adjacent the bottom of the side cover flap. Also, the glue flap extensions have glue strips applied to them and the side cover flaps are overlapped and are glued to the glue-flap extensions. The result of these two features is a carton which is not well suited for semi-liquid material such as ice cream and the like, since when it melts it will tend to leak out between the various flaps forming the end walls of the carton. Moreover, the application of a horizontal glue strip across the inner end wall-forming flaps requires a support for those flaps, such as a mandrel or a filled carton.

OBJECTS OF THE INVENTION

It is an object of the invention to provide improvements in the packaging of semi-solid materials such as ice cream and the like. It is a further object of the invention to provide a carton or package which is simple to manufacture and which is essentially leak-proof. It is a further object of the invention to provide an improved method for making cartons and packages of the class described. It is a further object of the invention to provide novel tube cartons in which the bottom can be formed and sealed without a mandrel. It is still a further object of the invention to provide a package which has improved openability and improved reclosability and which affords improved protection to the contents thereof after opening. It is a further object of the invention to provide novel carton blanks which are adapted for manufacture from paperboard sheet stock in high-speed cutting and scoring machines. It is a further object of the invention to provide such a blank in which there is a minimal of stock wastage in the cutting and scoring operation and economy of raw material usage. Further objects are to avoid disadvantages of the prior art and to obtain such advantages as will appear as the description proceeds.

BRIEF DESCRIPTION OF THE INVENTION

The invention relates to improvements in the packaging of semi-fluid materials such as ice cream and the like and it particularly directed to an improved carton or package and improved tube carton and improved carton blank as well as to an improved method of making the same.

In accordance with one aspect of the invention, a carton tube or sleeve is made from an integral carton blank having a front panel, a bottom panel, a rear panel, a cover panel and a front cover sealing flap articulated one to the other in the order named in which the front cover sealing flap is attached to the front panel by a frangible seam and in which the closed end is formed of inner-end wall forming flaps attached to the front and rear panels and by top and bottom outer end wall-forming flaps, the first of which is a side cover flap attached to the end of the cover panel and the second of which is attached to the bottom panel, which carton tube is characterized in that the bottom outer end wall forming flap is glued to the inner end wall forming flaps by glue strips extending along the edges thereof which are attached to and adjacent the front and rear panels and in that the side cover flap has a tuck-in tab adapted to be inserted under the bottom outer end wall forming flap between the glue strips. Advantageously the glue strips extend from the bottom of the inner end wall forming flaps and the bottom of the bottom outer end wall-forming flap up to the top of the latter.

This effectively seals the end walls from the bottom up to the top of the bottom end wall-forming flap, thus precluding leakage between the inner end wall-forming flaps and the bottom outer end wall-forming flap. Advantageously the front cover sealing flap has a lateral glue-flap extension which is adapted to be glued to the side cover flap.

Also advantageously the frangible seam on the front cover sealing flap has a tear strip.

The tube or sleeve carton as formed, with the bottom or one end sealed, is filled with the material to be packaged and the other end, which has the same types of flap extensions, is closed and sealed in a like manner.

The several panels and the front cover sealing flap are separated by horizontal score lines and the flaps and the panels are separated by vertical score lines. It will be understood that the terms vertical and horizontal are used merely for the purposes or orientation and that if the blank is rotated 90 degrees, the vertical score lines become horizontal score lines and vice versa. The side flap extensions are separated from the front cover flap also by vertical score lines which are displaced with respect to the other vertical score lines so that the distance between them is greater than the distance between the other vertical score lines by that required for the glue-flap extension to overlap the side cover flap and thus allow the side cover flap to lie flat against the inner end wall formed by the inner end wall-forming flaps. The closer the cover flap lies along the end wall, the less leakage there will be.

In assembling the tube carton from the integral paperboard blank thus described, the front cover sealing flap is glued or otherwise fastened to the front panel, thereby forming a tube which when erected has a rectangular cross section and, when collapsed, is flat. The collapsed tube coming from stock is opened up and the inner end wall-forming flaps are folded in. The side-cover flap is then folded down over the folded-in inner end wall-forming flaps. Glue strips are then applied to the glue strip areas on the outer edges of the inner wall formed by the folding in of the inner wall-forming flaps and the one adjacent the front of the carton tube is extended up over the folded down side-cover flap. The bottom end wall-forming flap is then folded up over the tucked in tab of the side-cover flap and the glue flap extensions are folded in over the glue strip on the side cover flap, and the bottom outer wall-forming flap and the glue-flap extension are caused to adhere to the glue strips to form a sealed end.

Desirably, when the glue strips are applied, the bottom outer end wall-forming flap and the glue-flap extension are bent out of the way and a hot-melt glue is applied by rollers or guns, or other means, starting either at the top or at the bottom of the application at the front of the carton extending up over the folded-down side-cover flap, and the application at the side that is adjacent to the rear panel either starting or terminating at or adjacent to the bottom of the side-cover flap. The tube carton thus formed is then filled and the other end closed in the same manner. The blanks according to the invention are adapted for making either top-opening or side-opening cartons. In the form shown, the top and bottom panels are wider than the rear and front panels, so that the resulting carton is a top-opening carton. Thus, when the tear strip is torn, the cover, which has a front cover flap which is glued to the side-cover flaps by the glue-flap extensions, can be raised up to expose the contents and then closed again with the tuck-in tabs tucked in to hold the cover securely in place.

In accordance with a preferred form of the invention, the side flaps, including the glue-flap extension, progressively diminish in size from the front panel to the front cover sealing flap so that, when two flat blanks are side by side in reverse position, the inner wall-forming flap attached to the front panel abuts the side-cover flap of the other blank, and so on, so that there is very little scrap lost in the cutting and scoring of the blanks from a continuous sheet of stock. Advantageously, the inner outer corners of the inner wall-forming flaps attached to the front panels are cut away to accommodate the tuck-in tab.

If desired, however, one or the other of the inner wall-forming flaps can be extended to fit snugly into or to cover the end of the carton tube. In the latter case, the outer edge of such a flap desirably is short enough so that it does not overlie the glue strip area, otherwise it must be glued to the underlying flap.

Advantageously, the front panel has a top edge cut down to form corner posts at the sides thereof so that the cover fits firmly and snugly against the carton after it is opened.

In some cases, it is desirable to provide a fold-in flap on the top edge of the front panel adapted to fold in under the cover and thus improve the seal when the cover is closed. When this flap is attached to the cut-down edge and the cover is closed, it will angle up to prevent leakage or seepage of the product between the front panel and the front cover flap.

If desired, the front cover flap can be glued to cut-scored portions of the front panel to hold it flat and firm in the collapsed tube. This has a further advantage that, when the tear strip is removed and the cover flap pulled forward, the pull-outs will be left on the inside of the cover flap and thus form detents when the cover is closed to hold the cover in closed position. The fold-in flap on the front cover is particularly of advantage in this case, because it acts as a ramp for the cut-outs to slide over when the cover is closed and as a spring to pull into contact with the hole from which they were cut out.

The carton blanks of the invention have the advantage that the tube carton and package can be formed therefrom without the use of mandrels and, as compared with methods requiring mandrels, result in substantial savings both in the machinery required for forming, filling, and closing the package and in savings in the floor space required to house the same.

DETAILED DESCRIPTION OF THE DRAWINGS

In the drawings:

FIG. 5 is an isometric view of the opened-up tube of FIG. 3.

FIG. 6 is a partial view of FIG. 8, showing the inner end wall-forming flaps folded in.

FIG. 7 is a partial view showing the cover side flap folded in, remaining flaps folded out, hot-melt glue strips applied, and stylized applicators therefor.

FIG. 8 is a view in which the remaining flaps of FIG. 7 are folded into place to form the closed end of the carton tube.

FIG. 11 is a partial view showing the other inner end wall-forming flap folded in.

DETAILED DESCRIPTION OF THE INVENTION

Figure 1:
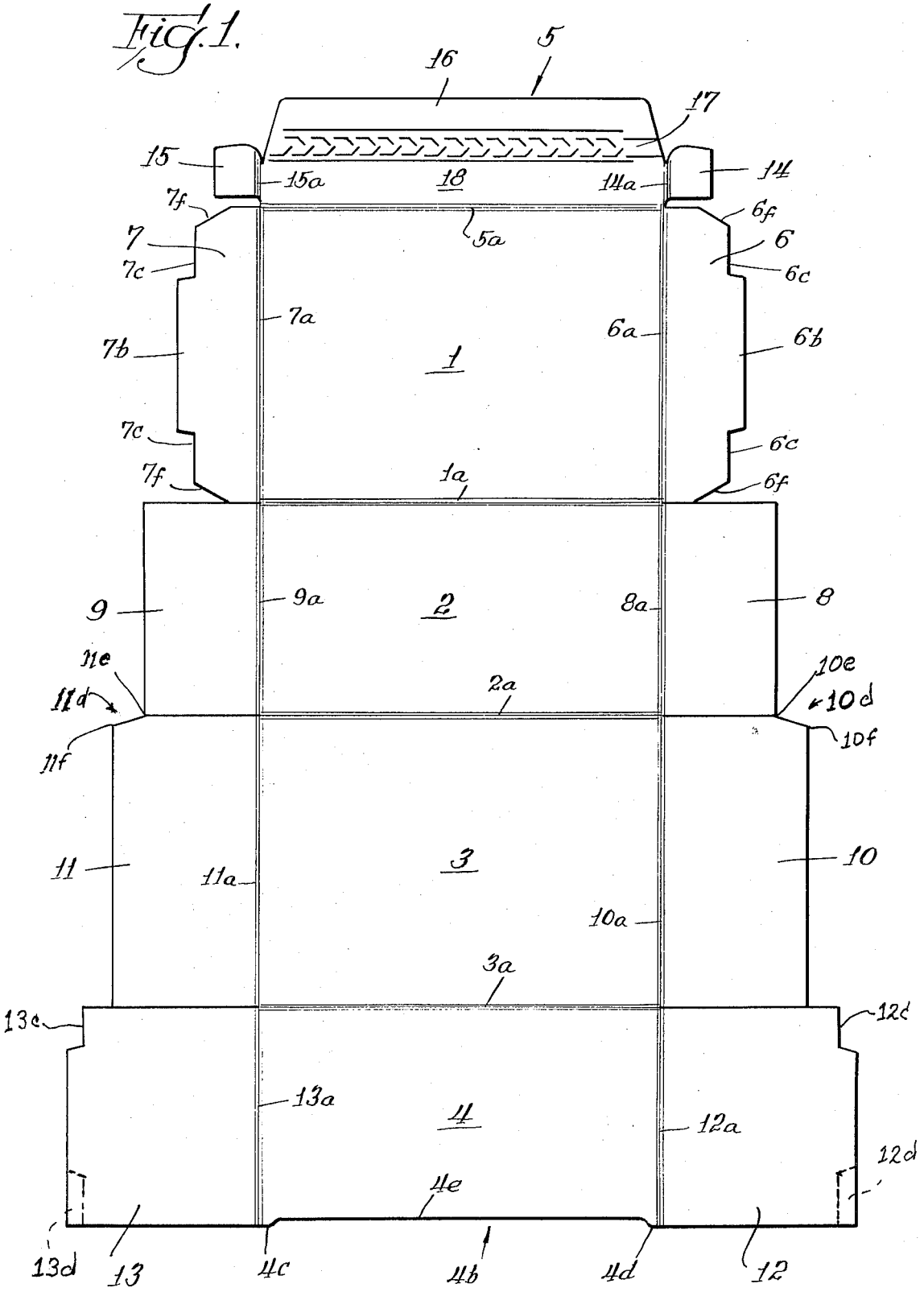
FIG. 1 is a plan view of a carton blank.

Referring now particularly to FIG. 1, there is shown a carton blank having panels 1, 2, 3, and 4, articulated in that order by horizontal score lines 1*a*, 2*a*, and 3*a*. The panel 1, which is the cover-forming panel, has articulated thereto sealing flap 5 by the horizontal score line 5*a*.

Extending laterally from the panels 1, 2, 3, and 4, are side-forming panels 6 through 13, which are articulated with the panels by means of the vertical score lines 6*a* through 13*a*. The flaps 6 and 7 are side-cover flaps. Flaps 8 and 9, which extend laterally from the rear panel 2, are inner end wall-forming flaps. Flaps 10 and 11, which extend laterally from the bottom panel 3, are partial outer end wall-forming flaps. And flaps 12 and 13, which extend laterally from the front panel 4, are inner end wall-forming flaps.

The cover sealing flap 5 has a glue tab 16 connected to the cover flap 18 by tear strip 17. Projecting laterally from the cover flap 18 are glue-tab extensions 14 and 15, which are articulated therewith by vertical score lines 14*a* and 15*a*. The vertical score lines 7*a*, 9*a*, 11*a*, and 13*a* are aligned in an essentially common vertical score line and, similarly, with respect to score lines 6*a*, 8*a*, 10*a*, and 12*a*. The score lines 14*a* and 15*a*, however, are displaced laterally with respect to the other vertical score lines, so that the distance between the score lines 14*a* and 15*a* is greater than the distance between the score lines 6*a* and 7*a* such that, in the erected carton, the glue-tab extensions 14 and 15 overlie the cover side flaps 6 and 7.

Figure 2:
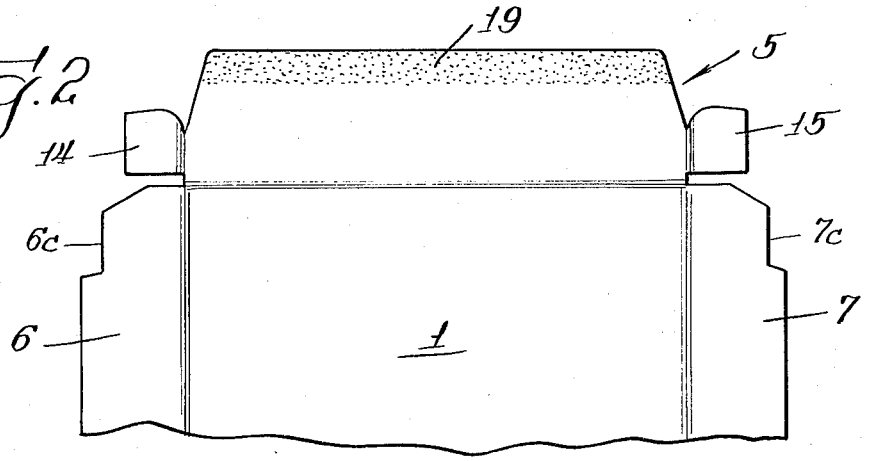
FIG. 2 is a detail view of a modified form of FIG. 1.

In FIG. 2, the tear strip 17 is omitted and a frangible glue 19 is applied so that the cover can be readily broken away from the front panel.

Figure 3:
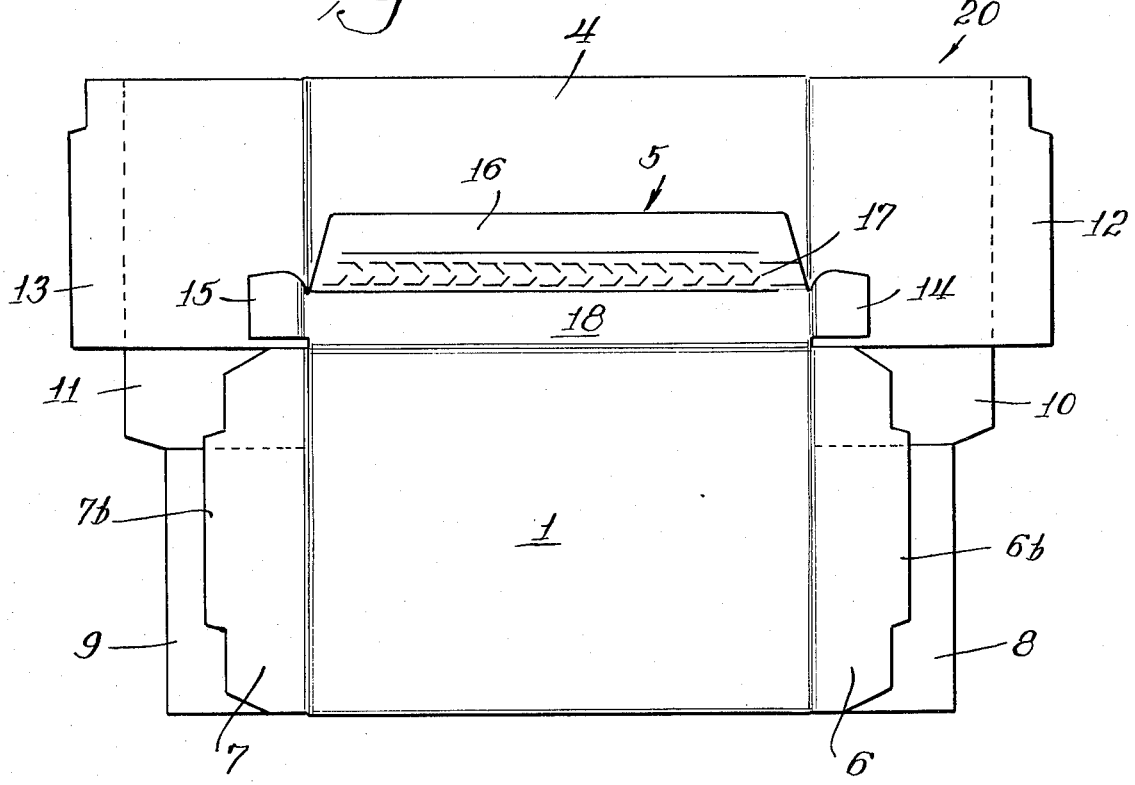
FIG. 3 is a collapsed carton tube formed of FIG. 1.
Figure 4:
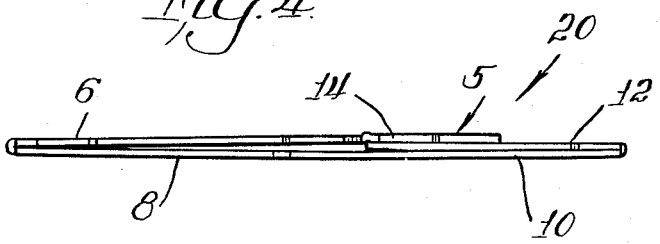
FIG. 4 is an end view of FIG. 3.

In FIGS. 3 and 4, the glue tab 16 is glued to the front panel 4, to form a collapsed tube, which can be opened up into the tube shown in FIG. 5.

The side-cover flaps 6 and 7 are provided with tuck-in tabs 6*b* and 7*b*. These tabs extend over the greater portion of the bottom edge of the side-cover flaps 6 and 7, but are inset from the ends thereof as shown at 6*c* and 7*c*, for a purpose which will become apparent in the description of the assembly of the carton.

In assembling the carton, the inner end wall-forming flap 8, which is attached to the rear panel 2, is folded in first and then the inner end wall-forming flap 12, which is attached to the front panel 4, is folded in to overlie flap 8, as shown in FIG. 6, or vice versa. Then the side-cover flap 6 is folded down, the outer end wall-forming flap 10 and the glue-tab extensions 14 are folded back out of the way and hot-melt glue applicators A and B apply hot-melt glue strips 6*d*, 12*e* and 8*c*. The hot-melt applicator, B, first contacts the side-cover flap 6 and deposits the glue strip 6*d* and then continues on to deposit the glue strip 12*e*. Concurrently, as the glue strip 12*e* is applied, the glue strip 8*c* is applied by glue applicator A. The applicators A and B are programmed so that the glue strip 6*d* is applied first and then the glue strip 8*c* and 12*e* applied simultaneously. If desired, the glue strip 6*d* can be applied independently of the application of the glue strip 12*e*. Also, if desired, the glue strips can be applied in the reverse order, that is, from the bottom panel upward. Either the glue applicators A and B can be mounted to move over the carton tube of FIG. 7, or the glue applicators A and B can be stationary and the partially-assembled tube of FIG. 7 passed under or over or, in any event, passed into contact with the glue applicators A and B.

Advantageously, the partially assembled tube cartons can be moved along a continuous belt (not shown), with the open end resting on the belt and the end to be sealed, uppermost. In such case, it is desirable that the movement be in the direction of the folded-back flap 10, so that any tendency for the flaps 8 and 12 to be displaced will be corrected by the flap 6, which is folded down over the folded-in flaps 8 and 12.

Since the glue strips are applied adjacent the score lines, the front and rear panels provide support for the flaps so that the sealing of the ends can be effected without a mandrel or before the carton is filled.

The next step is to fold in the outer wall-forming flap 10 and the glue-flap extension 14 into contact with the glue strips, as shown in FIG. 8.

It will be observed that the outer wall-forming flap 10 and the side-cover flap 6 are proportioned so that the flap 10 covers the tuck-in tab 6*b* and essentially abuts the inset portions 6*c*, thereby forming the outer wall of the end of the carton.

Figure 9:
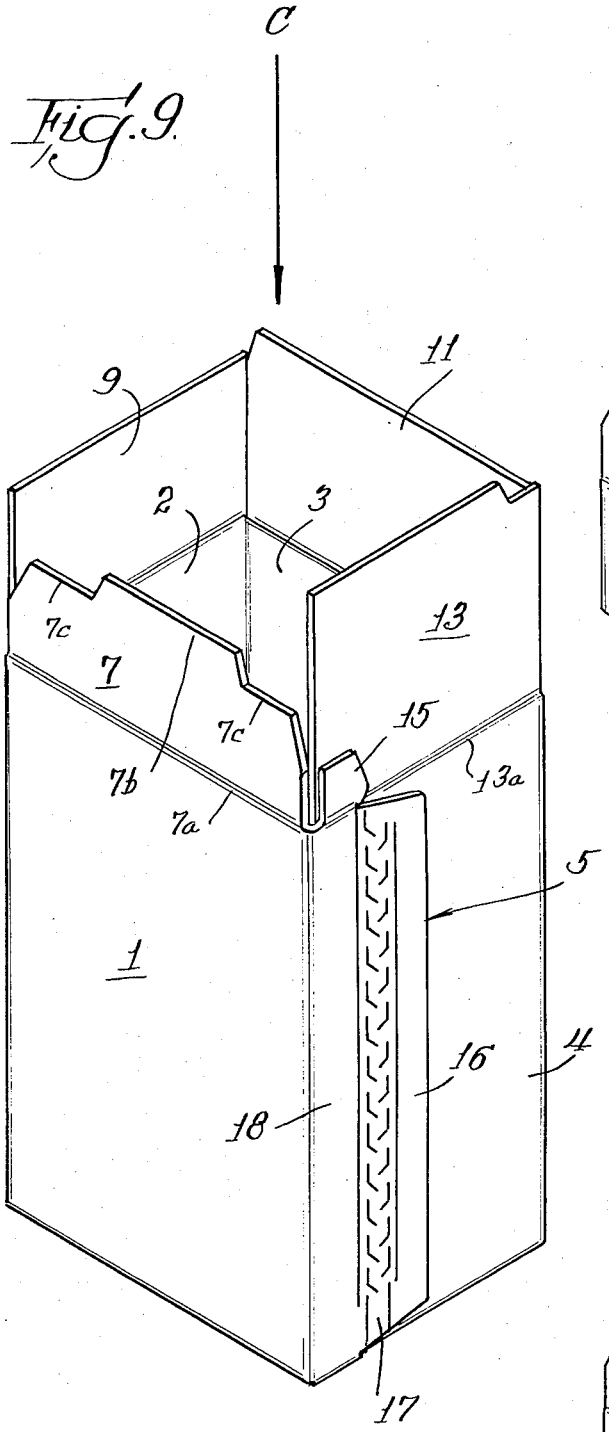
FIG. 9 is an isometric view of the closed end of the carton tube in position to be filled.
Figure 10:
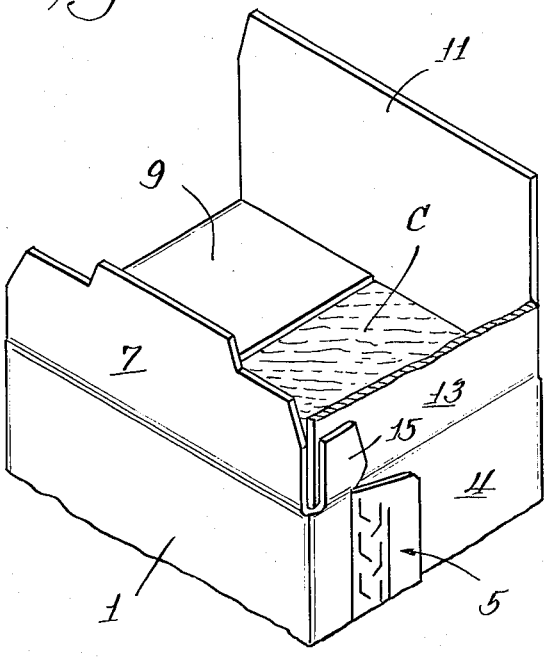
FIG. 10 is a partial view of the filled carton tube with one of the inner end wall-forming flaps folded in over the contents.
Figure 11:
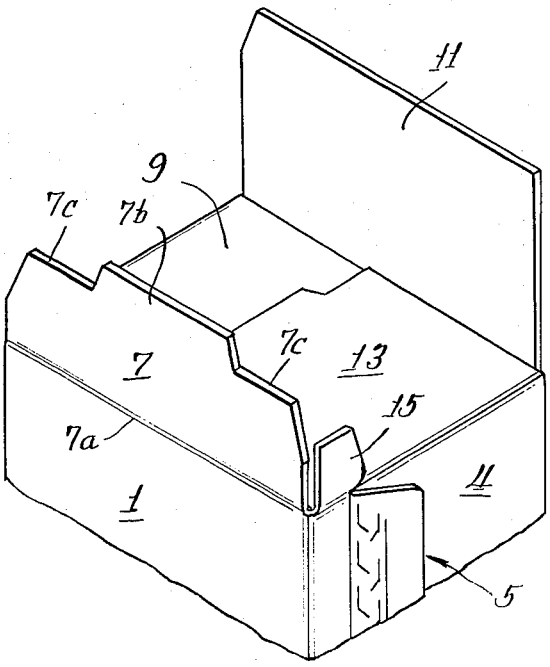
Figure 13:
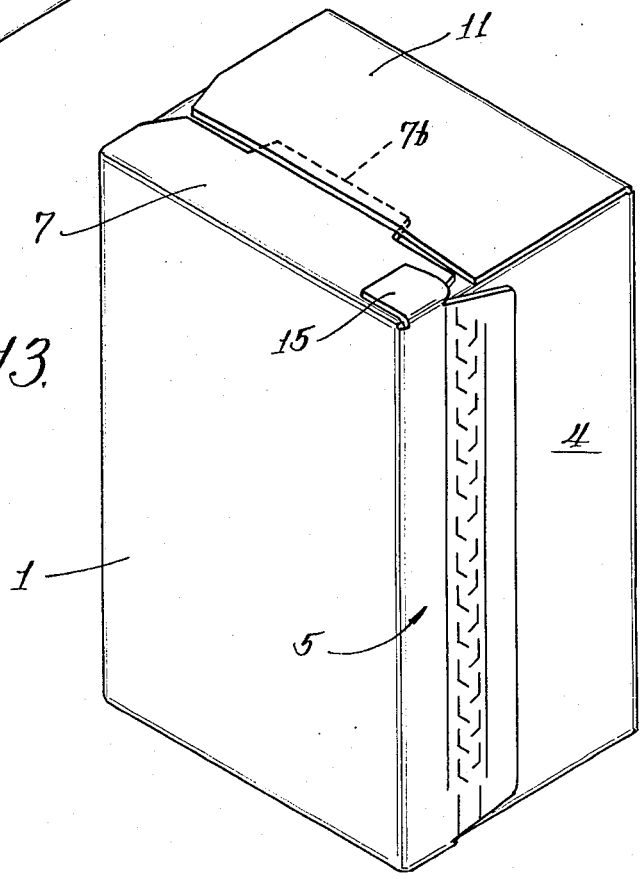
FIG. 13 shows the finished package in which the folded-out flaps of FIG. 12 have been folded over into contact with the glue strips.
Figure 14:
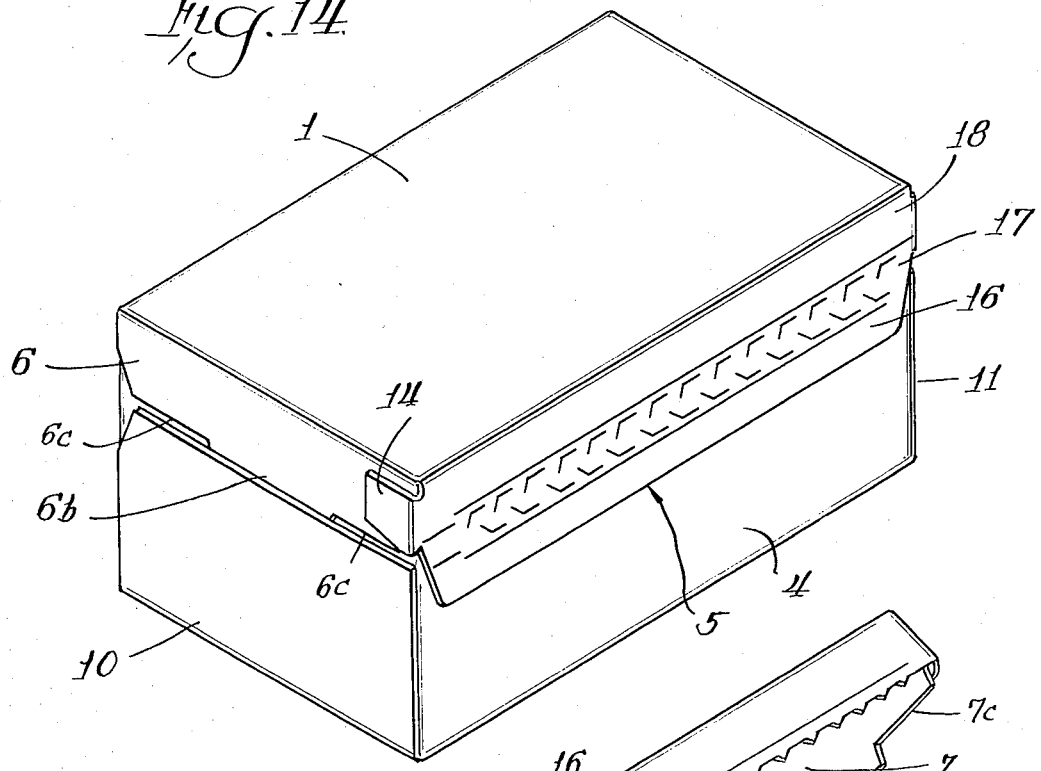
FIG. 14 is an isometric view of the finished package of FIG. 13.

The partially-assembled carton, with one end sealed and the other end open, is passed under a filling station, as shown in FIG. 9, where a semi-solid material at ambient temperature C, which suitably is ice cream, sherbet, or the like, is introduced into the open-ended tube until it is filled to the level of the score lines. The inner end wall-forming flap 9 is then folded in, as shown in FIG. 10, followed by the folding in of the overlapping end wall-forming flap 13, or vice versa, as shown in FIG. 11. The sealing process is then carried out, as shown in FIG. 12, in the same way that the other end was sealed, as shown in FIG. 7, to form a finished package, as shown in FIGS. 13 and 14.

Figure 15:
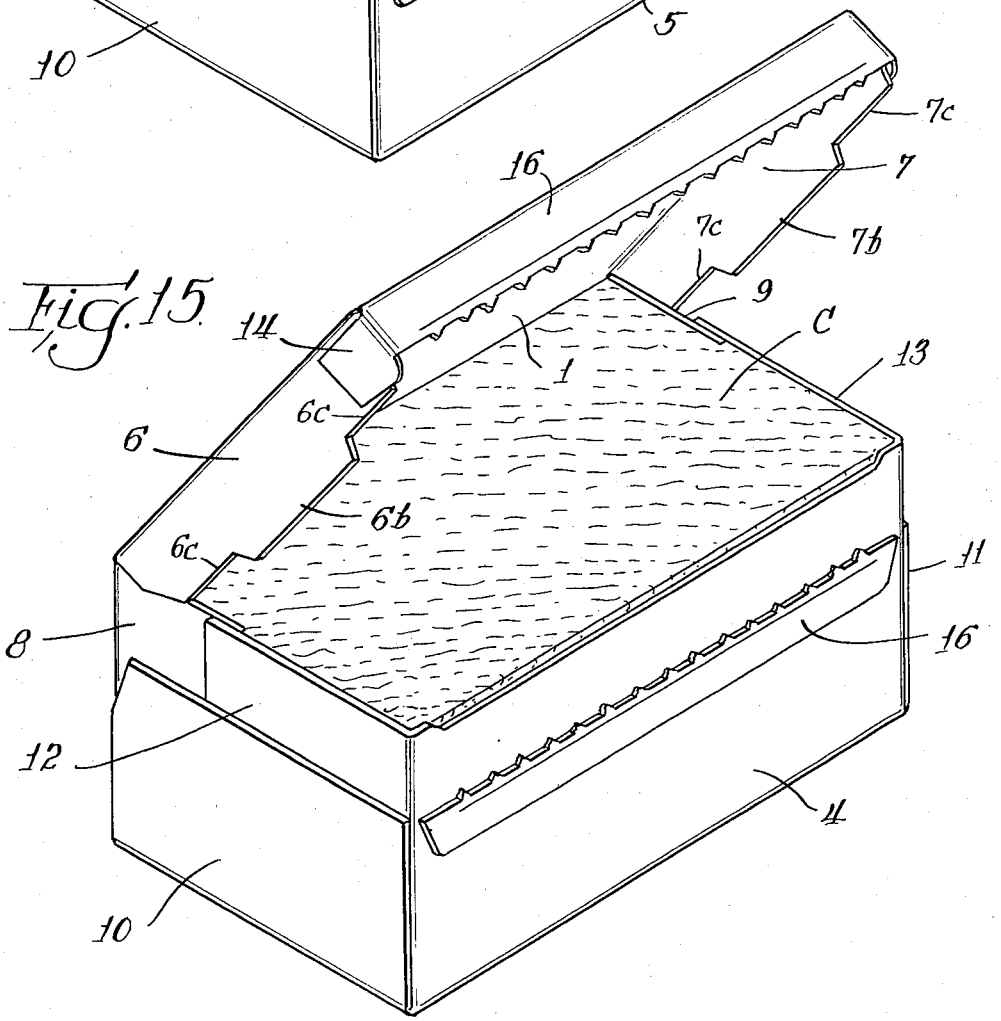
FIG. 15 is an isometric view showing the cover raised.

When the tear strip 17 is removed, the cover can be raised, as shown in FIG. 15, and again closed, with the tuck-in tabs 6*b* inserted between the outer end-wall flap 10 and the inner end-wall flap 12.

Figure 12:
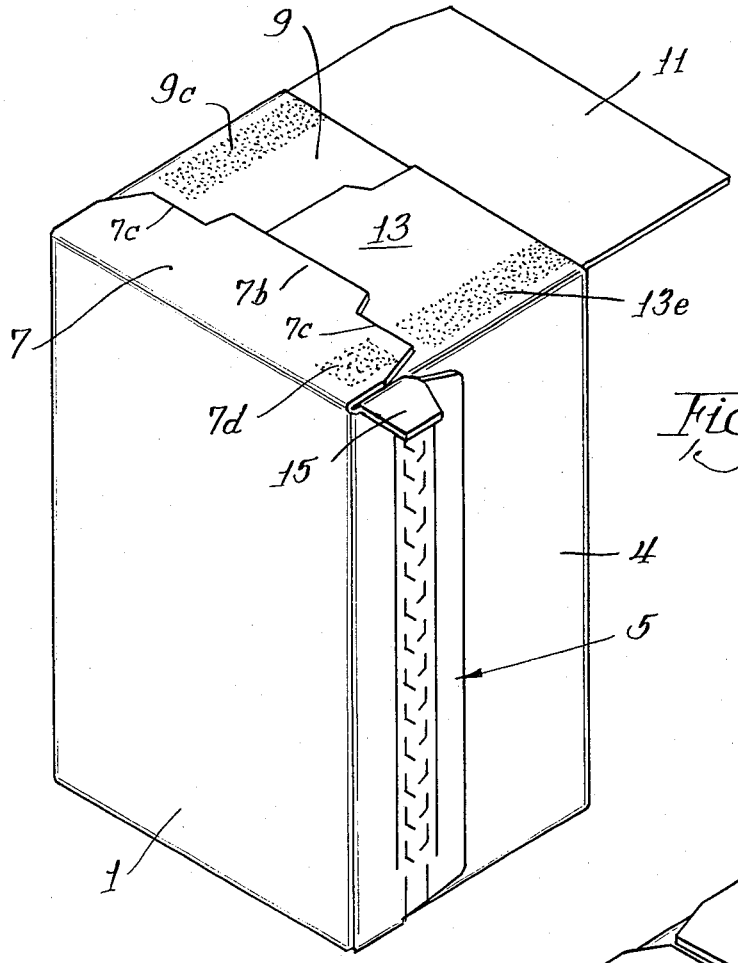
FIG. 12 is an isometric view showing additionally the cover side flap folded in and the other flaps folded out, together with glue strips of hot-melt glue applied as in FIG. 7.

The insets 6*c*, as best seen in FIGS. 7 and 12, are inset just enough to accommodate the glue strips 8*c* and 12*e*. Similarly, the insets 7*c* are inset just enough to accommodate the glue strips 9*c* and 13*e*.

The glue strips 8*c* and 12*e* extend down to the bottom of the inner wall-forming flaps 8 and 12 and, if desired, partly onto the outer end wall-forming flap 10 so that, when the flap 10 is folded up, a leak-proof seal between the flaps 8, 10, and 12 is obtained. Similarly, in connection with FIG. 12, a leak-proof or leak-resistant seal is obtained between the flaps 9, 11, and 13.

By virtue of the fact that the glue-tab extensions 14 and 15 are on the outside of the side-cover flaps 6 and 7, the side-cover flaps 6 and 7 lie flat against the inner end wall and enhance both the strength of the cover and the leak-proof character of the package. In the prior art, the glue-flap extensions are folded under the side-cover flaps and are glued to the underside thereof, thus placing a short layer of paperboard between the side-cover flap and the end wall. This separates the side-cover flap from the end wall and promotes leakage. In the invention, on the other hand, the glue-flap extensions overlap the side-cover flap and are glued to the outside thereof, so that the side-cover flap lies flat against the end wall. This minimizes leakage because the more extensive the flat surface-to-surface contact between the side-cover flaps and the end walls, the less tendency there is for leakage to occur. In FIG. 1, it will be observed that the front panel is cut down at 4*b* to provide shoulders 4*c* and 4*d* adjacent the score lines 12*a* and 13*a*. Thus, the top edge 4*e* of the front panel 4 is slightly below a line extending from the shoulder 4*c* to the shoulder 4*d* and parallel thereto. This cooperates with the outside sealing of the glue-tab extensions 14 and 15, further to enhance the leak-proof feature of the container.

This feature can still further be enhanced by attaching to the top lip 4*e*, a flap as shown at 4*f*, in FIG. 16, the function and construction of which will be described more particularly in connection with FIG. 16.

Figure 16:
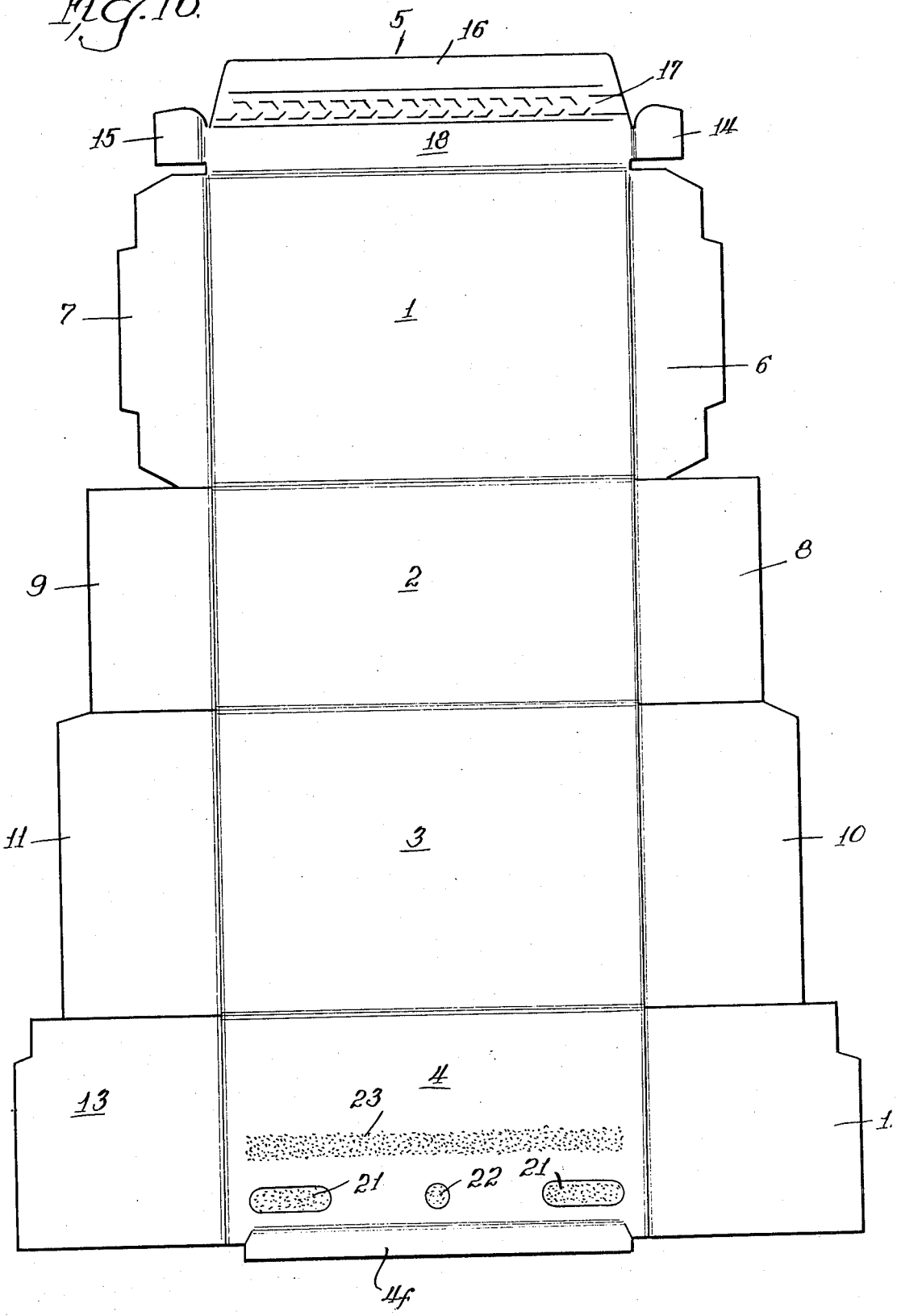
FIG. 16 is a plan view of a modified carton blank.
Figure 21:
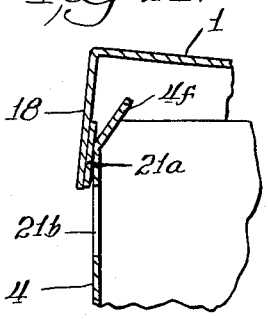
FIG. 21 is a partial section of the modification of FIG. 20 showing the cover detached and partially raised.
Figure 20:
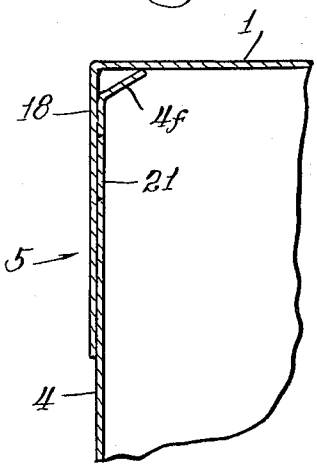
FIG. 20 is a detailed section of a carton assembled from the blank of FIG. 16.

In FIG. 16, there is shown a modification which has the flap 4*f* and cut-scored pull-outs 21 and 22 located in the portion of the front panel 4 which underlies the front-cover flap 18. Glue is applied to these pull-outs 21 and 22 and to the portion of the panel underlying the glue tab 16 so that, when the front cover-sealing flap 5 is sealed to the front panel, the whole sealing flap will be held in flat contact with the front panel 4, from the collapsed position shown in FIG. 3, through all the subsequent operations. Then when the tear strip 17 is removed and the cover raised, the pull-outs 21 and 22 will adhere to the cover and not seriously interfere with the opening of the cover. Furthermore, when the cover is closed, the pulled-out portions will engage the holes from which they were pulled out and act as detents to hold the cover closed. This can more readily be seen from FIG. 21, where the pulled-out portion 21 is attached to the front-cover flap 18, in position to enter the hole 21*b*. Also, it will be observed in FIGS. 20 and 21, when the flap 4 is bent in under the cover 1, it will angle up so that its lip engages the inner surface of the cover panel 1, as shown in FIG. 20. When the cover is raised, as shown in FIG. 21, the tab 4*f* tends to spring up so that when the cover is again closed and the pull-out 21*a* seated in the hole 21*b*, a tight and intimate seal is effected.

If desired, the pull-outs 21 and 22, or the equivalent thereof, can be in the flap 4*f*, or 104*f*. Alternatively, the tab 4*f*, or 104*f*, can be spot-glued to the cover panel.

Even when the pull-outs 21 and 22 are not employed, the flap 4*f* will have a similar effect due to the friction between the side and front cover flaps of the cover panel 1, with the carton sides. The flap 4*f* also makes it possible to effectively eliminate the pull-outs 21 and 22 entirely. The flap 4*f* has its edge in contact with the inner surface of the cover panel, as shown in FIG. 20, and thus, effectively prevents leakage in a filled carton, even if the top portion of the front panel is separated from the front cover panel. The flap 4*f* thus eliminates the need for a double glue line.

Figure 17:
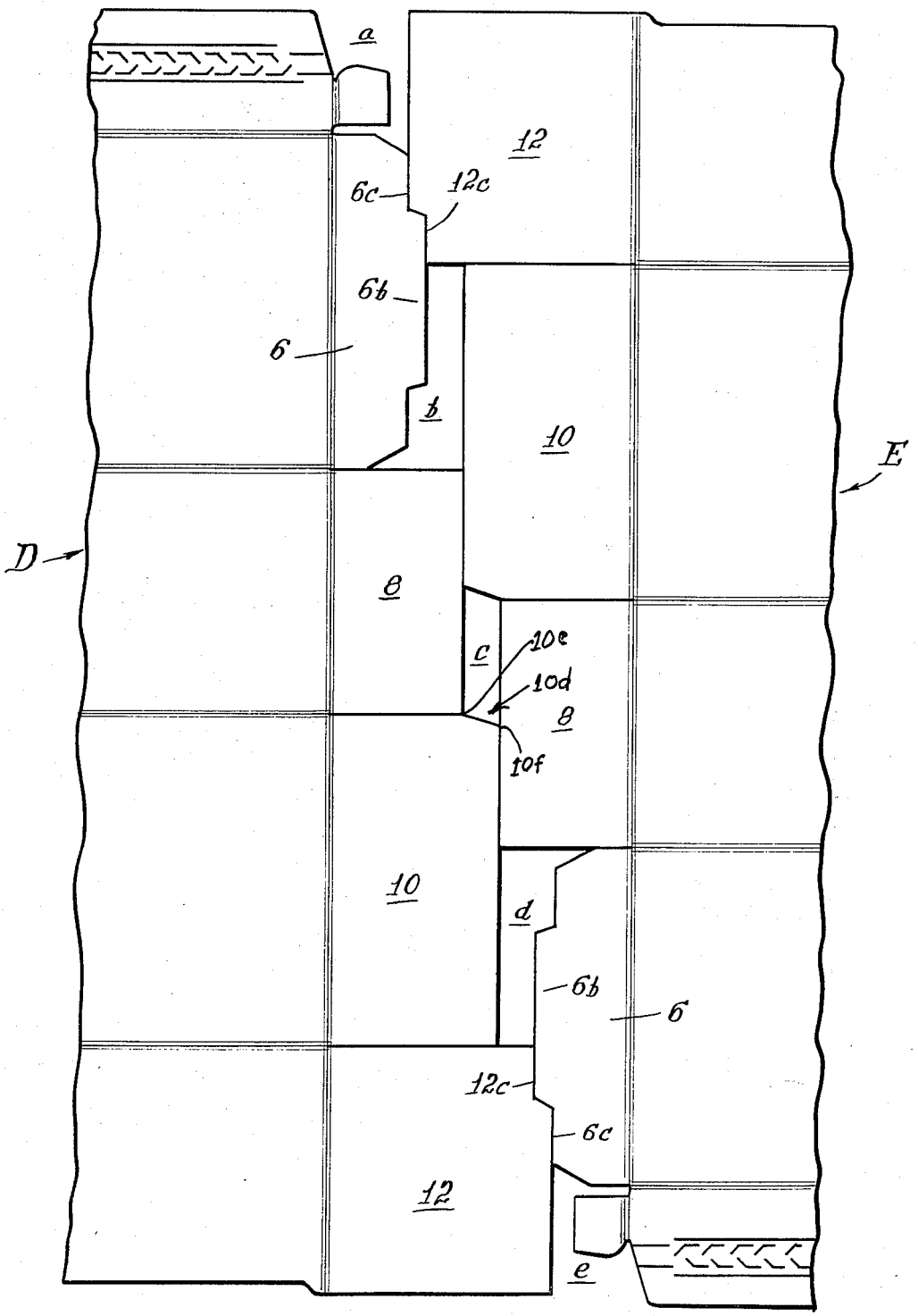
FIG. 17 is a plan view illustrating how the carton blanks of FIG. 1 are cut and scored from stock sheet material.

FIG. 17 illustrates how the carton blanks of the invention are particularly adapted to high-speed production from continuous sheet or roll stock and high-speed cutting and scoring machines. It will be observed that the laterally-extending flaps are progressively wider, so that when the blank E is placed in juxtaposition to blank D in reverse order, the wider flaps of blank D are opposite the narrower flaps of blank E, and so on. Thus, the inner end wall-forming flap 12 abuts the side-cover flap 6 and has a cut-out portion 13*c* which abuts tuck-in tab 6*b*. The outer wall-forming flap 10 abuts the inner wall-forming flap 8; the inner wall-forming flap 8 abuts the outer wall-forming flap 10; the side-cover flap 6 abuts the inner end wall-forming flap 12, which also has a cut-out portion 12*c* which abuts and is complementary with the tuck-in tab 6*b*; just as the cut-out portion 12*c* of the other blank is complementary with the tuck-in tab 6*b*. It will thus be observed that, essentially, the only scrap material is that shown by the portions a, b, c, d, and e. The result is a carton blank of the smallest area of any glue-sleeve ice-cream carton known in the art.

It will be observed more clearly in FIGS. 1 and 17, that the outer end-forming flaps 10 and 11 have their outer inner corners, i.e., the corners which are adjacent the rear panel, flaps 8 and 9, cut off, as shown at 10*d* and 11*d*. The purpose of this is best seen in FIG. 8, where the bottom corner 10*e* is firmly affixed to the glue strip 8*c* and the upper corner 10*f*, if not firmly attached to the glue strip 8*c*, is still inset from the panel 2, so that it is not an easily engaged corner which could be pulled up during the making or handling of the finished package or carton.

Figure 18:
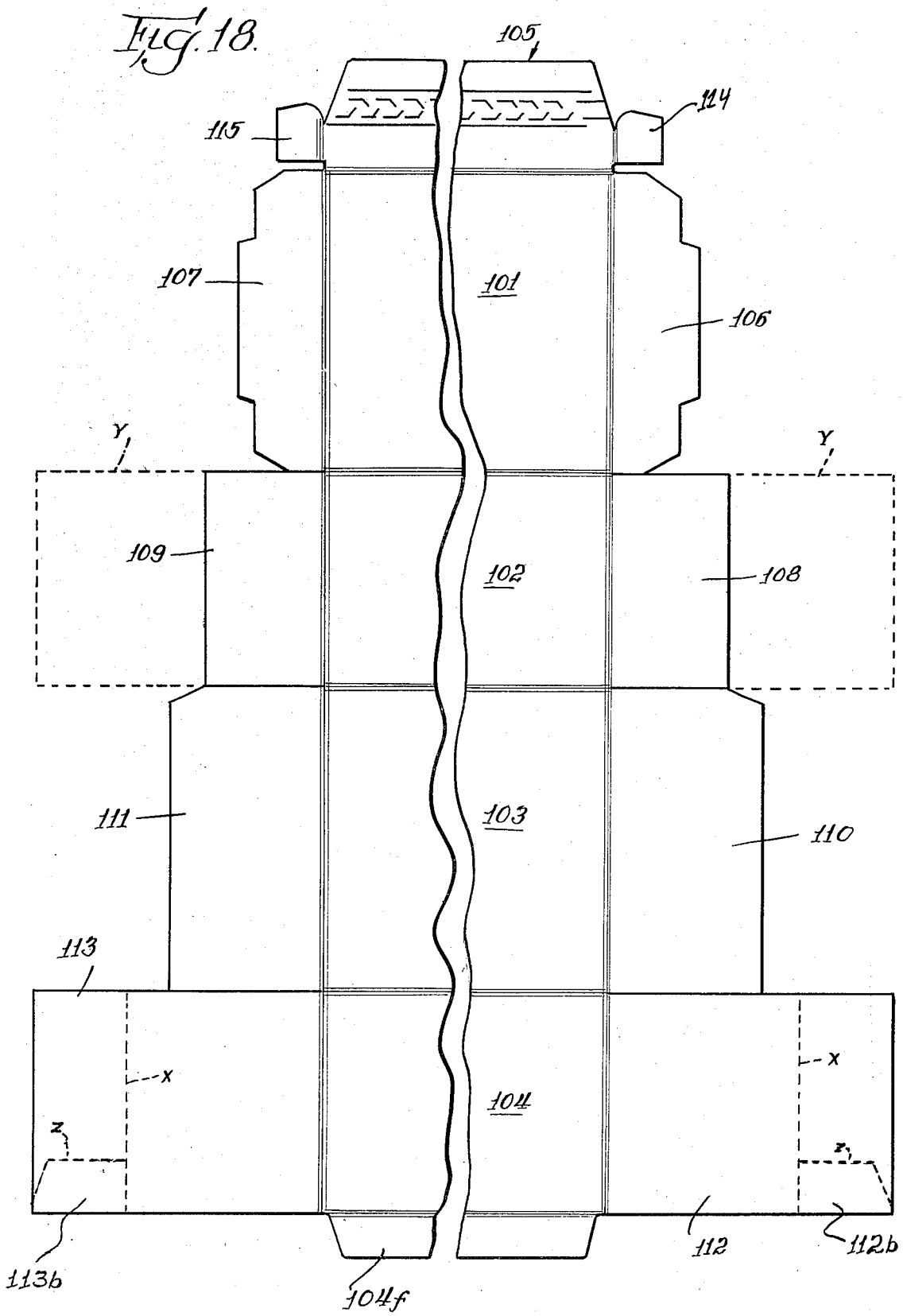
FIG. 18 is a plan view of a modified carton blank.

In FIG. 18, there is shown a modification in which one or the other or both of the inner end wall-forming flaps is extended beyond the dotted line x or, to the dotted lines y, so that it occupies the full end of the carton tube, and thus overlies completely the contents of the tube. It is of advantage, however, that only one of these flaps be so extended, since if the overlying flap does not terminate short of the glue area, it will have to be joined (glued) thereto by a separate glue line applied along the edge of the underlying flap adjacent to the panel to which it is attached. Otherwise, the outer end wall-forming flap 110 would be glued to the free end of the overlapping inner end wall-forming flap, so that the effective seal would not be obtained without the extra glue line.

The inner end wall-forming flaps 112 and 113 can be cut on the dotted lines Z–Y to provide the flap extensions 112*b* and 113*a*. When the flaps 112 and 113 so cut away overlie flaps 108 and 109, the extensions 112*b* and 113*a* will extend under the cover flaps 106 and 107 to the rear panel. This, coupled with the glue-flap extensions 114 and 115 overlying the side-cover flaps 106 and 107, make for continuous flat contact between the side-cover flaps 106 and 107 and the end wall formed by the folded-in end wall-forming flaps. If desired, the extensions 112*b* and 113*a* can be glued to the underlying flaps. The stock for the extensions 112*b* and 113*a* can be obtained largely from the waste area "a" of FIG. 17.

Figure 19:
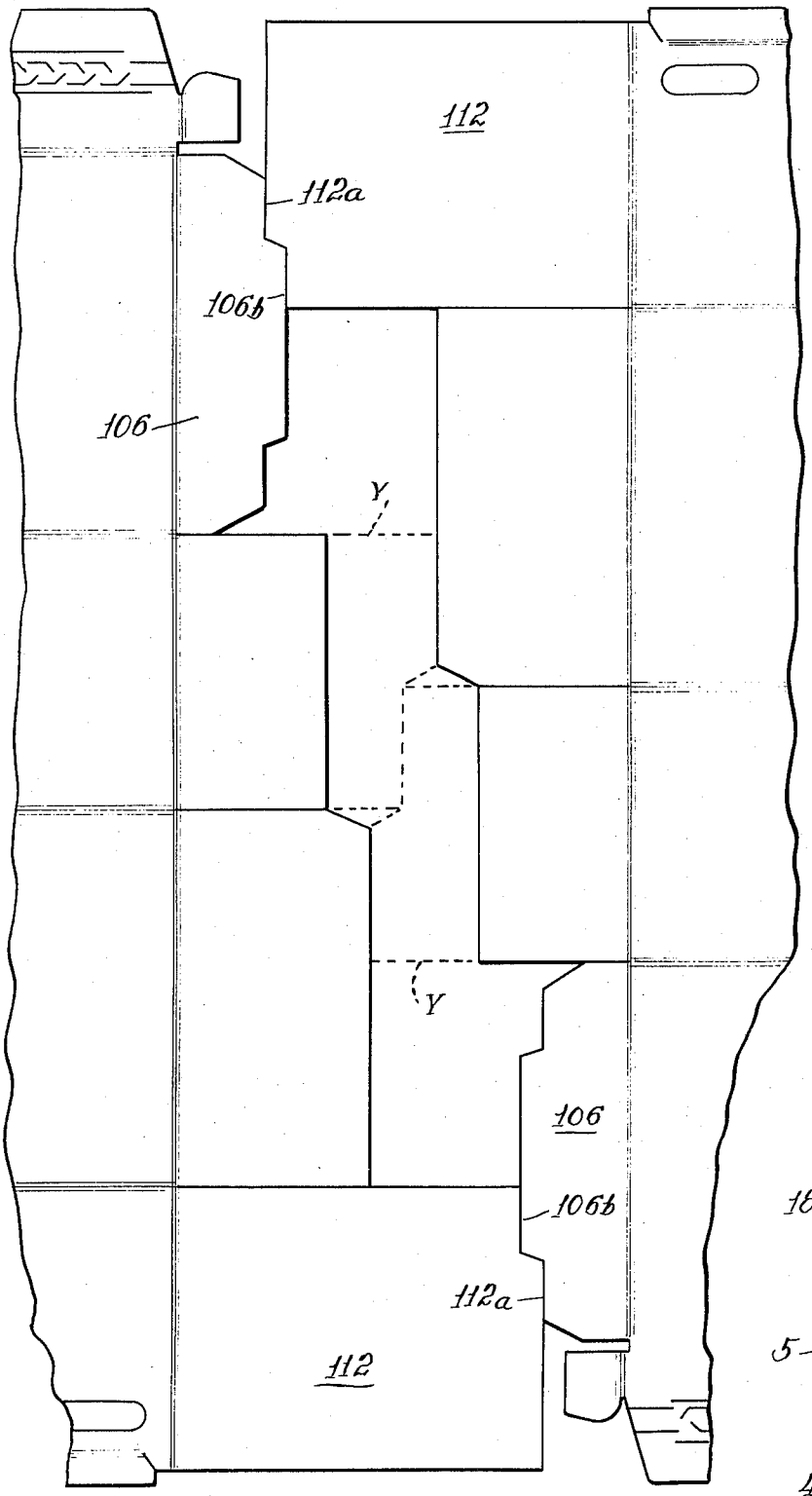
FIG. 19 is a plan view of another modified carton blank showing how this blank is cut and scored from stock sheet material.

In this figure and in FIG. 19, the parts corresponding to the parts of FIG. 1 bear the same reference numerals, plus 100.

In FIG. 19, there is illustrated a modification of FIG. 18, in which the extended underlying inner end wall-forming flaps 112 have cut-outs 112*a* which are complementary with the tuck-in tabs 106*b*, so that this modification, too, can be easily formed in a continuous manner with high-speed cutting and scoring machines without too much loss of stock.

The side-cover flaps 6 and 7 have their corners cut off at 6*f* and 7*f* to avoid sharp corners which otherwise would tend to curl up.

As shown in FIG. 1, the outer inner corners of flaps 12 and 13 are cut out, as shown at 12*c*. This has the advantage that the overlap of flaps 12 and 13 with flaps 8 and 9 at the bottom of the carton is minimal. This results in a more leak-proof carton. The same advantage can be obtained at the top by cutting out the outer outer corners of the flaps 12 and 13, as shown in dotted lines, at 12*d* and 13*d*. When this is done, the flaps 12 and 13 have a minimal overlap with flaps 8 and 9 at both the top and bottom and the result is that there is less likelihood of the contents seeping out of the package.

It is to be understood that the invention is not to be limited to the exact details of operation or structure shown and described, as obvious modifications and equivalents will be apparent to one skilled in the art.

I claim:

1. An integral blank for forming a top-opening carton having an elongate front panel, an elongate bottom panel, an elongate rear panel, an elongate cover panel, and an elongate front cover sealing flap; said panels being articulated to one another in the order named, and said front cover sealing flap being articulated to said cover panel, by horizontal parallel score lines, and said front cover sealing flap being adapted to overlie said front panel and to be sealed thereto to form said panels into a tube having a rectangular transverse cross section in opened-up position and into a collapsed parallelogram in the folded-together position; said front and rear panels having laterally-projecting, inner end wall-forming flaps articulated thereto by vertical score lines, each of the inner end wall-forming flaps, in the erected carton, being adapted to overlap the other inner end wall-forming flap and overlie it on only one side thereof; said bottom panel having a laterally-projecting, outer end wall-forming flap articulated to a side thereof by a vertical score line and adapted to be bent up to a position to overlie said inner end wall-forming flaps; said cover panel having a laterally-extending side cover flap articulated to a side edge thereof by a vertical score line adapted to overlie the inner end wall-forming flaps when the carton is erected; and the front cover flap having a glue-flap extension articulated to a side edge thereof by a vertical score line, which extension is adapted to be glued to said side cover flap to form, with said cover panel, a cover hinged to said rear panel and adapted to overlie the side and front panels of the assembled carton; the improvement in which there is a tuck-in tab at the edge of said side cover flap, which tab extends over the greater portion of the edge of, but is inset from the ends of the side cover flap from which it extends and from the front and rear panels of the erected carton, thereby leaving, along the edges of each said inner end wall, a narrow strip for the application of strips of glue for fastening the outer end wall-forming flap thereto while leaving sufficient space between the glue strips for the insertion of the tuck-in tab between the inner and outer end walls, in which said other inner end wall-forming flap has a free edge extending in a straight line all the way across its face parallel to the score line which joins it to the panel from which it projects whereby, in the erected carton tube, the overlying inner end wall-forming flap lies flat against the face of said other inner end wall-forming flap all the way from said top panel to said bottom panel and in which said glue-flap extension is attached to the end of said front cover flap adjacent said side-cover flap by a vertical score line offset sufficiently to permit the glue-flap extension to overlie the side-cover flap in the erected carton and to be glued thereto by an extension of the glue strip which fastens the outer end wall-forming flap to the overlapping inner end wall-forming flap adjacent to and parallel to the side edge of the front panel whereby, in the assembled carton, the side cover flap, when the tuck-in tab thereof is inserted beneath the outer end wall-forming flap, lies flat against the overlying inner end wall-forming flap in surface to surface contact therewith throughout the length thereof.

2. An integral carton blank of claim 1, in which the inner end wall forming flap attached to said front panel is longer than and, in the erected carton, overlies said other inner end wall-forming flap and the two flaps are of such relative lengths that, in the erected carton, the free end edge of the longer one overlies a relatively small portion only of the free end edge of the shorter one, underlies the side cover flap in surface contact therewith, and does not overlap the glue-strip area of the shorter one, whereby the glue can be applied along and adjacent the fold lines of the inner end wall-forming flaps, down to the corners, between them and the outer end wall-forming flap and an essentially leak-proof container is provided.

3. An integral carton blank of claim 2, in which, in the erected carton, the free end edge of the overlying inner end wall-forming flap is substantially closer to the free end edge of the overlapped inner end wall-forming flap than it is to the fold line thereof.

4. An integral carton blank of claim 2, in which the longer inner end wall-forming flap is cut away adjacent the bottom panel sufficiently to provide minimal overlap adjacent the bottom panel in the erected carton.

5. An integral carton blank of claim 1, in which the front panel has a narrow fold-in flap articulated thereto at another horizontal score line at its top edge and adapted to fold under the cover of a carton erected from said blank, said fold-in flap functioning, when a closed-end tube is formed from said blank, as a reinforcement for the top edge of said front panel, and to effect contact with the inner surface of said cover panel.

6. An integral carton blank of claim 1, in which the top edge of said front panel is cutaway, leaving two shoulders, one adjacent the edges thereof and connected by a linear horizontal top edge just slightly below the line connecting the tops of said shoulders, and in which the front panel has a narrow fold-in flap articulated thereto at another horizontal score line at its top edge and adapted to fold under the cover of a carton erected from said blank.

7. An integral carton blank of claim 6, in which the front cover flap is attached to a tear strip having a portion therebeyond adapted to be glued to said front panel, and in which the portion, of the front panel which the front cover flap is adapted to overlie, has plugs cut-scored for ready removal to which the cover flap can be glued whereby, when said tear strip is removed and said front cover flap pulled forward, the cut-scored plugs will come out with the front cover flap and will function as detents for holding the cover closed, and narrow fold-in-flap functioning as a spring member to help keep the detents engaged.

8. A package which comprises a filled closed-end tube made from a blank according to claim 1, in which at least one end is closed by the cover side flap overlying the folded-in inner end wall-forming flaps with the outer one overlying the underlying one in flat surface to surface contact from the top panel to the bottom panel, by the outer end wall-forming flap overlying the tuck-in tab of the folded-down side cover flap and being glued to the inner end wall-forming flaps by glue strips adjacent the outer edges thereof which do not extend above the top edge of the outer end wall-forming flap or across the inner end wall-forming flaps, and in which the folded-down side cover flap has a short glue strip which lies under the glue-flap extension and glues the glue-flap extension to the side cover flap, whereby said side cover flap overlies the overlying inner end wall-forming flap in flat surface to surface contact therewith throughout the length thereof, said short glue strip lying in line with the glue strip adjacent the front panel.

9. A package according to claim 8, in which the front panel inner end wall-forming flap is longer than and overlies the other and the two are of such relative lengths that the free end of the longer one overlaps a relatively small portion only of the free end of the other, and in which the glue strips extend down to the corners of the outer end wall-forming flaps and the inner end wall-forming flaps to provide, in cooperation with the surface to surface contact between the cover side flap and the overlying inner end wall-forming flap, an essentially fluid-tight seal along the glue lines and between the cover side flap and the inner end wall.

10. An integral carton blank of claim 1, in which the glue flap extension, the side cover flap, the rear panel inner end wall-forming flaps, the outer end wall-forming flaps, and the front panel inner end wall-forming flaps are all progressively wider in a step-wise fashion in the order named, whereby two said blanks can be laid side-by-side in reverse order with shorter flaps at one end of one blank opposed to longer flaps at the other end of the other blank in order to cut down waste material when the blanks are cut out from sheet material.

11. An integral carton blank of claim 10, in which said front panel inner end wall-forming flap has a cut-out portion which is complementary in shape with the shape of the corresponding portion of the tuck-in tab and in which the flaps have widths such that, when the two blanks are juxtaposed in side-by-side reverse order, the front panel end wall-forming flap of one blank touches the side cover flap of the other blank, the cut-out portion of the front panel inner wall-forming flap touches the tuck-in tab of the other blank, the outer end wall-forming flap of one blank touches the rear panel inner end wall-forming flap of the other blank, the rear panel inner end wall-forming flap of the one blank touches the outer end wall-forming flap of the other blank, the tuck-in tab of the one blank touches the cut-out portion of the front panel inner end wall-forming flap of the other blank, and the side cover flap of the one blank touches the front inner end wall-forming flap of the other blank whereby, when said blanks are cut out of a stock sheet, a minimal amount of scrap results.

12. An integral carton blank of claim 10, in which the dimensions of the flaps are such that, in the side-by-side position, the free ends of the front panel inner end wall-forming flap of one blank abuts the free end of the side-cover flap of the other blank; the free end of the outer end wall-forming flap of said one blank abuts the rear panel inner end wall-forming flap of said other blank; the free end of the rear panel inner end wall-forming flap of said one blank abuts the free end of the outer end wall-forming flap of said other blank; and the free end of the side-cover flap of said one blank abuts the front panel inner end wall-forming flap of said other blank.

13. An integral carton blank of claim 1, in which at least the top portion of the overlying inner end wall-forming flap extends, in the erected carton, from the front panel to the rear panel, whereby there is flat surface to surface contact from the front panel to the rear panel, in the erected carton, between said top portion and said overlying side-cover flap.

14. An integral carton blank of claim 13, in which, the overlying inner end wall-forming flap does not extend over the glue strip area of the underlying end wall-forming flap.

15. An integral carton tube having front, cover, rear, and bottom panels having a closed end which is formed by overlapping inner end wall-forming flaps which project from said front and rear panels, a bottom outer end wall-forming flap which projects from said bottom panel, and a side cover flap having a tuck-in-tab, which flap projects from said cover panel and which tuck-in tab underlies said outer end wall-forming flap and is spaced from said front and rear panels, with each of said inner end wall-forming flaps overlapping the other inner end wall-forming flap and overlying it on only one side thereof, with the side cover flap overlying the folded-in overlying inner end wall-forming flaps in surface to surface contact therewith, and with the outer end wall-forming flap overlying the tuck-in tab and being glued to the inner end wall-forming flaps at each side thereof by glue strips immediately adjacent said front and rear panels and which do not extend above the top edge of the outer end wall-forming flap or crosswise across the inner end wall-forming flaps, said cover panel being fastened to said front panel by means of a front cover flap which has a glue-flap extension which overlies said folded-down side cover flap and is fastened thereto by a short glue strip which lies in line with the glue strip adjacent the front panel, said other inner end wall-forming flap having a free edge extending in a straight line all the way across its face parallel to the score line which joins it to the panel from which it projects, whereby the overlying inner end wall-forming flap lies flat against the face of the inner end wall-forming flap underlying it all the way from said top panel to said bottom panel, and said glue-flap extension being attached to the end of said front cover flap adjacent said side-cover flap by a vertical score line offset sufficiently to permit the glue-flap extension to overlie the side-cover flap whereby the side cover flap, with the tuck-in tab thereof inserted beneath the outer end wall-forming flap, lies flat against the overlying inner end wall-forming flap in surface to surface contact therewith throughout the length thereof.

16. A closed-end integral carton tube according to claim 15, in which the inner end wall-forming flap which projects from the front panel overlies the other inner end wall-forming flap, and in which the glue strips extend down to the corners of the outer end wall-forming flaps to provide, in cooperation with the surface to surface contact between the cover side flap and the overlying front panel inner end wall-forming flap, an essentially fluid-tight seal along the glue lines and between the cover side flap and the inner wall.

17. A closed-end integral carton tube according to claim 16, in which the front panel has a fold-in flap attached to the upper edge of the front panel which fold-in flap underlies the top panel.

18. A closed-end integral carton tube according to claim 16, in which the rear outer corner of said outer end wall-forming flap is cut at an angle so that the cut corner of said flap is inward at the score line between the rear panel and the inner end wall-forming flap attached thereto and adjacent to the glue strip along said score line.

19. A closed-end integral carton tube of claim 15, in which, at the closed end thereof, an outer corner of one of the inner end wall-forming flaps is cut away to reduce the area of overlap of the inner end wall-forming flaps.

20. A closed-end integral carton tube of claim 15, in which, at the closed end thereof the inner end wall-forming flaps at least the top portion of the overlying inner end wall-forming flap extends from the front panel to the rear panel, whereby there is flat surface to surface contact from the front panel to the rear panel between said top portion and the overlying side-cover flap.

21. A closed-end integral carton tube of claim 20, in which the portion of the overlying end wall-forming flap which extends from the front panel to the rear panel is glued to the underlying end wall-forming flap adjacent the fold line thereof.

22. The closed-end integral carton tube of claim 20, in which the overlying the portion of end wall-forming flap which does not underlie the side-cover flap, does not extend over the glue strip area of the underlying inner end wall-forming flap.

23. A closed-end integral carton tube of claim 22, in which the portion of the overlying end wall-forming flap which extends from the front panel to the rear panel is glued to the underlying end wall-forming flap adjacent the fold line thereof.

24. A closed-end carton tube made from an integral carton blank comprising a front panel, a bottom panel, a rear panel, a cover panel, and a front cover sealing flap articulated one to another in the order named, and having a rectangular transverse cross-section, in which the cover sealing flap is attached to the front panel by a frangible seam and in which the closed end comprises overlying and underlying inner end wall-forming flaps attached to said front and rear panels, each of which overlaps the other on only one side thereof, the underlying one having a straight-line free edge running from the top to the bottom thereof and there being flat surface to surface contact between the overlying and underlying portions from the top panel to the bottom panel and top and bottom outer end wall-forming flaps, the top one of which is a side-cover flap attached to the cover panel and the bottom of which is attached to the bottom panel, said bottom outer end wall-forming flap being glued to said inner end wall by glue strips extending only along the edges thereof immediately adjacent said front and rear panels and said side-cover flap having a tuck-in tab underlying said bottom outer end wall-forming flap between the glue strips and lying in flat surface to surface contact throughout the length of the overlying inner end wall-forming flap.

25. A carton tube according to claim 24, in which said front cover sealing flap has a laterally-extending glue-flap extension which overlaps said side-cover flap and is glued thereto by a glue strip in line with the glue strip adjacent the front panel.

26. A closed-end carton tube according to claim 24, in which the free end edge of the overlying inner end wall-forming flap is substantially closer to the free end edge of the underlying inner end wall-forming flap than it is to the fold line thereof.

27. A filled package made from an integral carton blank having a front panel, a bottom panel, a rear panel, a cover panel, and a front cover sealing flap articulated one to another in the order named, in which the front cover sealing flap is attached to the front panel by a frangible seam and in which both ends are closed, each of which comprises an overlapped pair of overlying and underlying inner end wall-forming flaps attached to each end of said front and rear panels, of which pair the underlying one has a straight-line, free edge running from the top to the bottom thereof and there being flat surface to surface contact between the overlapped portions from the top panel to the bottom panel, and top and bottom outer end wall-forming flaps, the top ones of which are side-cover flaps attached to the opposite ends of the cover panel and the bottom ones of which are attached to the opposite ends of the bottom panel, in which the bottom outer end wall-forming flaps are glued to said inner end wall-forming flaps by glue strips extending only along the edges thereof which are attached to and adjacent said front and rear panels and in which the side-cover flaps have tuck-in tabs inserted under said bottom outer end wall forming flaps between the glue strips and lie in flat surface to surface contact throughout the length of the inner end wall-forming flap.

* * * * *

UNITED STATES PATENT AND TRADEMARK OFFICE

CERTIFICATE OF CORRECTION

PATENT NO. : 4,239,115

DATED : December 16, 1980

INVENTOR(S) : Thomas W. Froom

It is certified that error appears in the above-identified patent and that said Letters Patent are hereby corrected as shown below:

FIGURES, FIG. 16, far right bottom corner of Figure 16; "1" should read -- 12 --

Col. 2, line 30; "or" should read -- of --

Col. 8, lines 7, 9, 15 and 16; "113a" should read -- 113b --

Col. 9, line 47; "surface contact" should read -- surface to surface contact --

Col. 11, line 36; "which, the" should read -- which, in the erected carton, the --

Col. 12, lines 39 and 40; "thereof the inner end wall-forming flaps at" should read -- thereof, at --

Col. 12, line 52; "which the overlying the portion of end" should read -- which the portion of the overlying end --

Signed and Sealed this

Ninth Day of June 1981

[SEAL]

Attest:

RENE D. TEGTMEYER

Attesting Officer

Acting Commissioner of Patents and Trademarks